United States Patent [19]

Stroszynski

[11] 4,098,188

[45] Jul. 4, 1978

[54] PRINTING PLATE

[75] Inventor: Joachim Stroszynski, Naurod, Fed. Rep. of Germany

[73] Assignee: Hoechst Aktiengesellschaft, Fed. Rep. of Germany

[21] Appl. No.: 730,680

[22] Filed: Oct. 7, 1976

[30] Foreign Application Priority Data

Oct. 8, 1975 [DE] Fed. Rep. of Germany ..... 2544971

[51] Int. Cl.[2] ..... B41N 1/00; B41N 3/00

[52] U.S. Cl. ..... 101/458; 101/459; 101/465; 101/471; 428/328; 428/403; 427/192; 427/203; 96/86 R; 96/33

[58] Field of Search ..... 96/86 R, 33; 428/328, 428/403; 101/456–459, 465–467; 29/192 CP; 427/203, 192

[56] References Cited

U.S. PATENT DOCUMENTS 3,031,344 4/1962 Sher et al. ..... 252/514

*Primary Examiner*—John D. Welsh
*Attorney, Agent, or Firm*—James E. Bryan

[57] ABSTRACT

This invention relates to a printing plate comprising a support bearing either (A) a layer comprising particles each containing a hydrophilic metal core and an oleophilic metal casing or (B) a layer comprising particles each containing an oleophilic metal core and a hydrophilic metal casing.

18 Claims, 4 Drawing Figures

PRINTING PLATE

Figure 1:
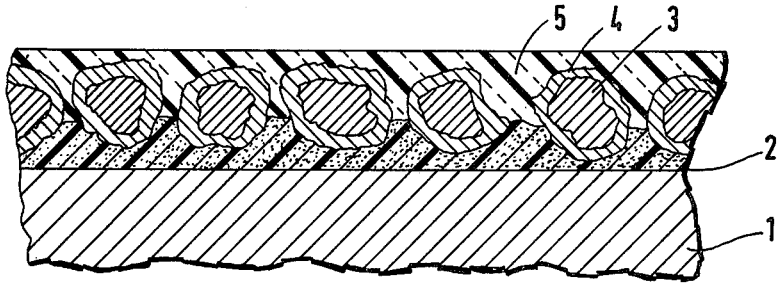

This invention relates to a printing plate having both hydrophilic and oleophilic metals.

Offset printing forms may be produced from printing plates in which a support carries a thin layer of hydrophilic metal and a thin layer of oleophilic metal one above the other, in either order, for example a hydrophilic nickel or chromium layer and an oleophilic copper layer. The printing image elements are produced from the oleophilic metal layer and the non-printing image background from the hydrophilic metal layer, for example, by photomechanical means using a lightsensitive layer capable of being etched. The bi- or multi-metal printing plates produce printing forms which are resistant to the mechanical abrasion occurring during printing and are therefore suitable for long printing runs. The two thin metal layers of printing plates are usually produced by electrochemical means. It requires, of course, a great deal of care and attention to produce flawless layers of uniform thickness from the two metals. Also, it is not easily possible to provide multi-metal plates with the fine-grained surface, which is desirable especially for the production of half-tone printing forms.

The present invention provides a printing plate comprising a support bearing either (A) a layer of particles each comprising a hydrophilic metal core and an oleophilic metal casing or (B) a layer of particles each comprising an oleophilic metal core and a hydrophilic metal casing.

The layer is advantageously of uniform thickness and the particles small, closely packed, and uniformly distributed over the support, to which they are preferably applied by the use of an adhesive. The support is advantageously thin, for example, a film. In practice, the metal of the cores of all the particles is the same, but this is of course not essential, provided that the cores are all either oleophilic or hydrophilic. The same applies to the casing, which is correspondingly hydrophilic or oleophilic.

A wide range of particle sizes may be used, depending on the intended effect. A particle size of approximately 0.010 mm for the core, and a thickness of approximately 0.002 for the casing are generally the most satisfactory. The dimensions given are for guidance only and it does not make any particularly great difference in the effect if the particle size of the core or the thickness of the casing is twice as large as, or half the size of, the dimensions quoted. In order to produce particular effects, the particle size of the core and the thickness of the casing may be considerably varied, either up or down, from the values quoted above; for example, they may be only a third of the size or five times the size. In addition it should be noted that these are average values. A range of particle sizes for the particles of a layer about an average value is usually advantageous because then a relatively thin coating of particles is sufficient to form an adequate covering of the supporting film. Preferably, at least 90% of the coated surface is covered by a single layer, having a thickness corresponding to the average particle size. A sufficiently dense covering of the surface of the supporting film with the particles can be achieved in various ways, for example, by coating, blasting or pressing the particles into a binder layer which previously has been applied to the support, or by applying a suspension of the particles in a liquid adhesive to the support and after drying and shrinking of the suspension medium the tops of the particles are freed from adhesive by washing. The particles also may be deposited on the supporting film by electrophoretic processes.

It has proved particularly advantageous to apply the suspension from a casting die. The combination of particles, adhesive and solvent is advantageously so selected that after drying the particles are tightly packed at the exposed surface. The process is preferably carried out by multi-layer coating, each coating being incomplete in itself, and after a given drying period, the coatings are reduced by means of a high pressure, applied in a line, to a few layers and, in the limiting case, one layer. It is possible when the cores are deformable to flatten, calibrate and level the surface. The linear pressure is advantageously produced by a resilient roller and a fixed roller which are pressed positively against one another. Preferably, the fixed roller presses on the coating. A layer-levelling pressing operation of this type can be repeated as long as the binder conforms to the deformation without damage. Following the coating or covering of the supporting film surface are further operations, for example, repetition of the particle covering or washing, and, where necessary, a process rendering the particle layer hydrophilic and sensitizing it.

The production of an image suitable for printing, which is necessary for the production of a printing form from the printing plates according to the invention, is most advantageously carried out by applying an etch-resistant layer to the particulate covering in the areas necessary for the production of the desired image, by etching the exposed areas of the metal casing covering the metal cores of the particles and subsequently removing the etch-resistant layer from the protected areas. If the casings of the particles are composed of the hydrophilic and the cores of the oleophilic metal, the etch-resistant layer must be applied in the areas of the particulate covering which are to be the printing areas in the printing form to be produced. The imagewise application of the etch-resistant layer could be carried out manually, for example, using a brush. Generally, however, the printing plate according to the invention is designed to be processed into a printing form by a photographic reproduction technique. The etch-resistant copying layers used in these processes, and their development into an etched stencil are known. Representative examples of many other etch-resistant layers known to the expert, which are suitable for the production of printing forms by reprographic means, are those known from the following German Pat. Nos. 955,927, as an example of tanned layers sensitized with bichromate, 1,447,017, as an example of tanned layers sensitized with organic azido compounds, 1,195,166, as an example of layers containing resin and sensitized with organic diazo compounds, 1,447,891, as an example of an electrophotographic etch-resistant layer and 2,027,467, as an example of an etch-resistant layer composed of photopolymers.

Figure 2:
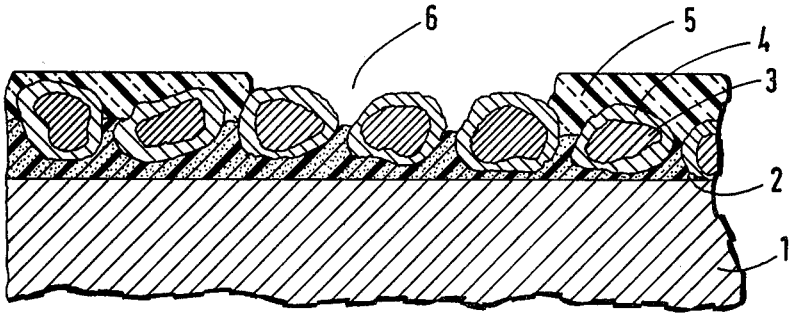
Figure 3:
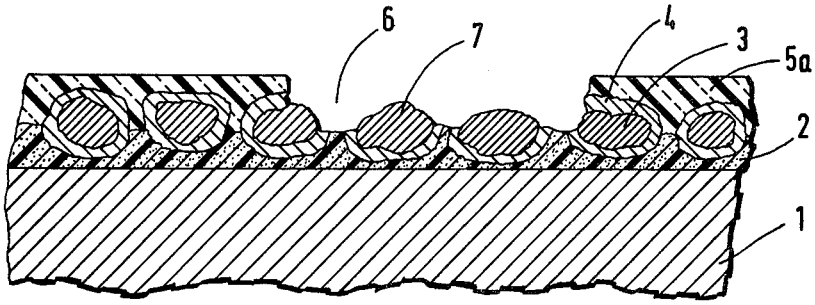
Figure 4:
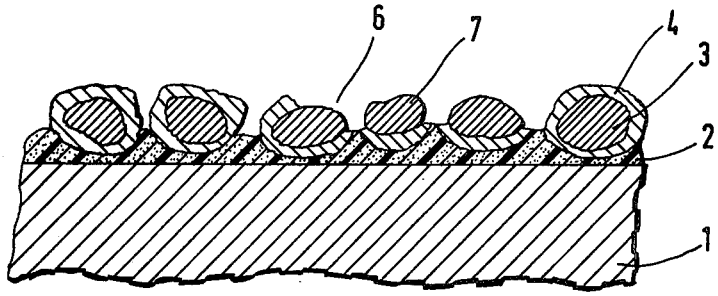

One form of plate constructed in accordance with the invention will now be described by way of example only with reference to the accompanying drawings, in which:

FIG. 1 shows in greatly enlarged schematic representation a portion of a section through a printing plate constructed according to the invention provided with a light-sensitive etch-resistant layer, FIG. 2 shows the plate of FIG. 1, after exposure and development of the etch-resistant stencil, FIG. 3 shows the plate of FIG. 2 after subsequent etching, and FIG. 4 shows the plate of FIG. 3 after removing the remainder of the etch-resistant layer.

Referring now to FIG. 1, a supporting film 1 has applied thereto an adhesive layer 2 and a bimetallic layer cemented thereby to the supporting film 1. The layer is composed of small particles which have a metallic core 3 and a metallic casing 4. The supporting film preferably is composed of a dimensionally stable material, for example a metal (for example, aluminum, iron, but preferably steel or zinc) or a plastic (especially polyethylene terephthalate). Hardenable epoxide resins, for example, are suitable for cementing the bimetallic particles 3, 4 to the support 1. As stated above, of the particles either the core 3 is hydrophilic and the casing 4 surrounding it oleophilic or vice versa. As hydrophilic metals may be employed, for example, aluminum, zinc, steel, chromium and nickel, and as oleophilic metals, for example, copper, brass and lead. The printing plate according to the invention shown in FIG. 1 is provided with a light-sensitive etch-resistant layer 5.

FIGS. 2 to 4 show the processing of the printing plate shown in FIG. 1 to form a printing form. FIG. 2 shows the stage of the processing in which the printing plate, after exposure under an image original, has been developed. FIG. 2 shows an area 6 of the printing plate surface which is uncovered during development. FIG. 3 shows the state of the printing plate after etching away the parts of the casing 4 bared by the development, whereby the upper parts 7 of the core surfaces are exposed at the etched areas. After removing the parts 5*a* of the etch-resistant layer 5 which remain on the surface of the printing plate during development, the result is the printing form shown in FIG. 4. Depending upon whether the etch-resistant layer used, together with the developing process applied, leads to a positive or to a negative development, it is the areas of the layer 5 screened from the incidence of light through the image original or the areas struck by light coming through the original during exposure of the printing plates which after development yield the areas 5*a* remaining on the printing plate surface. The printing plate may be suitable also for the production of printing forms according to half-tone originals; by this means it is possible to obtain good half-tone reproductions without the use of a screen.

The bimetallic printing plates according to the invention have the advantage that they can be produced in a relatively simple manner with consistent quality.

It will be obvious to those skilled in the art that many modifications may be made within the scope of the present invention without departing from the spirit thereof, and the invention includes all such modifications.

What is claimed is:

1. A printing plate comprising a support bearing a layer comprising particles each containing a hydrophilic metal core selected from the group consisting of aluminum, zinc, steel, chromium, and nickel, and an oleophilic metal casing selected from the group consisting of copper, brass, and lead.

2. A plate as claimed in claim 1 including an adhesive whereby the particles are attached to the support.

3. A plate as claimed in claim 2 wherein the particles are dispersed in an adhesive layer.

4. A plate as claimed in claim 1 wherein the support is a film.

5. A plate as claimed in claim 1 wherein the average particle size is about 0.014 mm.

6. A plate as claimed in claim 1 wherein the layer is generally one particle thick.

7. A plate as claimed in claim 1 also comprising an etch-resistant layer.

8. A plate as claimed in claim 7 wherein the etch-resistant layer is photosensitive.

9. A printing plate comprising a support bearing a layer comprising particles each containing an oleophilic metal core selected from the group consisting of copper, brass, and lead, and a hydrophilic metal casing selected from the group consisting of aluminum, zinc, steel, chromium, and nickel.

10. A plate as claimed in claim 9 including an adhesive layer whereby the particles are attached to the support.

11. A plate as claimed in claim 10 wherein the particles are dispersed in an adhesive layer.

12. A plate as claimed in claim 10 wherein the support is a film.

13. A plate as claimed in claim 1 wherein the average particle size is about 0.014 mm.

14. A plate as claimed in claim 10 wherein the layer is generally one particle thick.

15. A plate as claimed in claim 10 also comprising an etch-resistant layer.

16. A plate as claimed in claim 14 wherein the etch-resistant layer is photosensitive.

17. A process for the production of a bimetallic printing plate which comprises coating a support with a layer comprising particles each containing a hydrophilic metal core selected from the group consisting of aluminum, zinc, steel, chromium, and nickel, an oleophilic metal casing selected from the group consisting of copper, brass and lead, and etching the casings in a manner such that said cores are bared in selected areas of the plate surface.

18. A process for the production of a bimetallic printing plate which comprises coating a support with a layer comprising particles each containing an oleophilic metal core selected from the group consisting of copper, brass, and lead, a hydrophilic metal casing selected from the group consisting of aluminum, zinc, steel, chromium, and nickel.

and etching the casings in a manner such that said cores are bared in selected areas of the plate surface.

* * * * *

UNITED STATES PATENT OFFICE

CERTIFICATE OF CORRECTION

Patent No. 4,098,188 Dated July 4, 1978

Inventor(s) Joachim Stroszynski

It is certified that error appears in the above-identified patent and that said Letters Patent are hereby corrected as shown below:

Column 4, line 1 of Claim 12, "10" should read - - - 1 - - -.

Column 4, line 1 of Claim 14, "10" should read - - - 1 - - -.

Column 4, line 1 of Claim 15, "10" should read - - - 1 - - -.

Column 4, line 1 of Claim 16, "14" should read - - - 15 - - -.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*